US006050001A

United States Patent [19]

Ditrtrich

[11] Patent Number: 6,050,001

[45] **Date of Patent: *Apr. 18, 2000**

[54] SHOE HAVING LAYERED SHOCK ABSORBING ZONES

[75] Inventor: Ann Batchelder Ditrtrich, Naperville, Ill.

[73] Assignee: Florsheim Group Inc., Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/990,110

[22] Filed: Dec. 12, 1997

[51] Int. Cl.[7] ..... A43B 21/26; A43B 13/18

[52] U.S. Cl. ..... 36/35 R; 36/28; 36/31; 36/108

[58] Field of Search ..... 36/35 R, 28, 35 B, 36/31, 32 R, 44, 27, 59 C, 59 R, 103, 108, 148, 149

[56] References Cited

U.S. PATENT DOCUMENTS

| | | |
|---|---|---|
| D. 344,174 | 2/1994 | Kilgore . |
| D. 344,398 | 2/1994 | Kilgore . |
| D. 344,399 | 2/1994 | Kilgore . |
| D. 344,400 | 2/1994 | Kilgore . |
| D. 350,018 | 8/1994 | Kilgore . |
| D. 350,019 | 8/1994 | Kilgore . |
| D. 350,020 | 8/1994 | Kilgore . |
| D. 350,225 | 9/1994 | Kilgore . |
| D. 350,226 | 9/1994 | Kilgore . |
| D. 350,227 | 9/1994 | Kilgore . |
| D. 350,433 | 9/1994 | Kilgore . |
| D. 351,057 | 10/1994 | Kilgore . |
| D. 351,720 | 10/1994 | Kilgore . |
| D. 351,936 | 11/1994 | Kilgore . |
| D. 352,159 | 11/1994 | Kilgore . |
| D. 352,160 | 11/1994 | Kilgore . |
| D. 354,617 | 1/1995 | Kilgore . |
| D. 355,755 | 2/1995 | Kilgore . |
| 1,998,624 | 4/1935 | Hughes . |
| 2,145,994 | 2/1939 | Rubel . |
| 2,464,251 | 3/1949 | Moody . |
| 4,215,492 | 8/1980 | Sandmeier . |
| 4,342,157 | 8/1982 | Gilbert . |
| 4,342,158 | 8/1982 | McMahon et al. . |
| 4,541,184 | 9/1985 | Leighton . |
| 4,782,605 | 11/1988 | Chapnick . |
| 5,012,597 | 5/1991 | Thomasson . |
| 5,068,981 | 12/1991 | Jung . |
| 5,086,574 | 2/1992 | Bacchiocchi . |
| 5,131,174 | 7/1992 | Drew et al. . |
| 5,175,946 | 1/1993 | Tsai . |
| 5,224,277 | 7/1993 | Sang Do . |
| 5,233,767 | 8/1993 | Kramer . |
| 5,343,639 | 9/1994 | Kilgore et al. . |
| 5,363,570 | 11/1994 | Allen et al. . |
| 5,493,791 | 2/1996 | Kramer et al. . |
| 5,560,126 | 10/1996 | Meschan et al. . |
| 5,575,088 | 11/1996 | Allen et al. . |

FOREIGN PATENT DOCUMENTS

| | | |
|---|---|---|
| 2 221 387A | 9/1990 | United Kingdom . |
| 2 273 860 | 6/1994 | United Kingdom . |
| 2 273 037 | 8/1994 | United Kingdom . |

*Primary Examiner*—Ted Kavanaugh
*Attorney, Agent, or Firm*—Marshall, O'Toole, Gerstein, Murray & Borun

[57] ABSTRACT

A shock absorbent shoe includes an outsole having a toe, a heel, and a cavity in the heel. An elastomeric shock absorbing plug is disposed within the heel cavity and includes a planar lower surface and an upper surface. The upper surface of the plug includes a raised central portion, an outer boundary, and an annular depression separating the raised central portions from the outer boundary. The shoe is divided into a number of shock absorbing zones, with each of zones including one or more shock absorbing layers or components.

5 Claims, 5 Drawing Sheets

SHOE HAVING LAYERED SHOCK ABSORBING ZONES

FIELD OF THE INVENTION

The present invention relates generally to a shoe having improved shock absorption characteristics. More particularly, the present invention relates to a shoe having a plurality of shock absorption zones, each of which includes one or more layers and/or components, such as a resilient elastomeric heel plug or other shock absorbing structures.

BACKGROUND OF THE INVENTION

Shoe manufacturers constantly strive to make shoes which combine pleasing styles with a variety of functional considerations, such as comfort, durability, and shock absorption. Of these desired features, adequate shock absorption is the most difficult to achieve. Although favorable shock absorption characteristics may be relatively easy to obtain when making an athletic shoe, such as running shoes, basketball shoes, or walking shoes, obtaining adequate shock absorbing characteristics is made much more difficult when the shoe designer is constrained by the traditional aesthetic demands of the conventional dress shoe. Unfortunately, the conventional leather-soled dress shoe with a relatively hard rubber heel transmits a great deal of impact force to the wearer's foot, resulting in less comfort and increased fatigue.

A number of approaches have been tried in order to improve the shock absorption of conventional dress shoes. One such approach uses padded sockliners over hard insole boards. However, the padded sockliners typically bottom out under load, and the hard insole board results in an unusually stiff shoe which interferes with the foot's natural stride. Another approach is the use of molded unit soles, which give only partial comfort. Accordingly, there exists a need for an improved shoe construction for dress shoes as well as other types of shoes that provides enhanced shock absorption without interfering with the foot's natural stride.

SUMMARY OF THE INVENTION

According to one aspect of the present invention, an improved shock absorbing shoe construction includes an outsole having a toe, a heel, and a cavity in the heel portion. An elastomeric plug is disposed within the cavity, and has a planar bottom surface and an upper surface defined by a raised center portion, an outer boundary, and an annular depression separating the center portion from the outer boundary. The plug absorbs shock in the area of the wearer's heel, and is displaceable in response to an axial load through a first displacement phase, in which the load is resisted by the raised center portion, and a second displacement phase, in which the outer boundary is recruited to assist the center portion in accommodating the load.

The outer surface of the outsole includes a generally circular plunger structure which is generally coincident with the axis of the elastomeric plug. The plunger is surrounded by an annular depression, which permits the plunger, constructed integrally with the outsole of elastomeric polyurethane, to spread and thereby absorb additional shock. The insole, which overlies the outsole, includes a flexible bottom portion and has a transparent window over the elastomeric plug, enabling the shock absorbing plug to be viewed by a user upon removal of a flexible insert.

The central shank portion of the outsole includes a stiffening member which is molded integrally with the polyurethane outsole. The stiffening member adds stiffness to the shank and absorbs shock in the middle of the shoe while permitting the shoe to flex in accordance with the stride of the wearer's foot.

In further accordance with the preferred embodiment, the shoe includes a resilient multi-density elastomeric insert, which provides additional cushioning over the heel, the shank or middle of the shoe, and the toe. The insert includes a plurality of channels disposed generally parallel to the plane of the outsole which enhance the shock absorbing characteristics of the resilient elastomeric insert. The flexible insert also includes a plurality of ventilation holes perpendicular to the outsole to provide ventilation as the user walks.

In accordance with another aspect of the invention, an improved shoe includes an outsole having a heel, a toe, and a stiffening shank between the heel and the toe. An insole having a flexible bottom portion is secured to and overlies the outsole, and a flexible resilient insert overlies the insole. The outsole, the insole, and the insert define a plurality of shock absorbing zones, including a first zone generally coincident with the heel, a second zone generally coincident with the shank, and a third zone generally coincident with the ball of the wearer's foot.

In accordance with yet another aspect of the invention, a shoe includes an outsole having a rearward heel portion, a forward toe portion, and an interconnecting shank portion. An insole having a flexible bottom portion is secured to and overlies the outsole, and a flexible insert overlies the insole. The outsole, the insole, and the insert cooperate to define progressive shock absorbing means which absorbs and accommodates shock from the wearer's foot in response to the loads that occur during striding, so that load is progressively absorbed as the load travels between the heel portion and toe portion. The shock absorbing means is further defined in part by a plurality of cooperating shock absorbing zones, with each of the zones including one or more shock absorbing components, such as an elastomeric plug in the heel or a quantity of resilient elastomer in one or more areas of the flexible insert.

Further advantages and features of the present invention will become readily apparent to those skilled in the art upon a reading of the following description and claims.

DESCRIPTION OF THE PREFERRED EMBODIMENT

Figure 1:
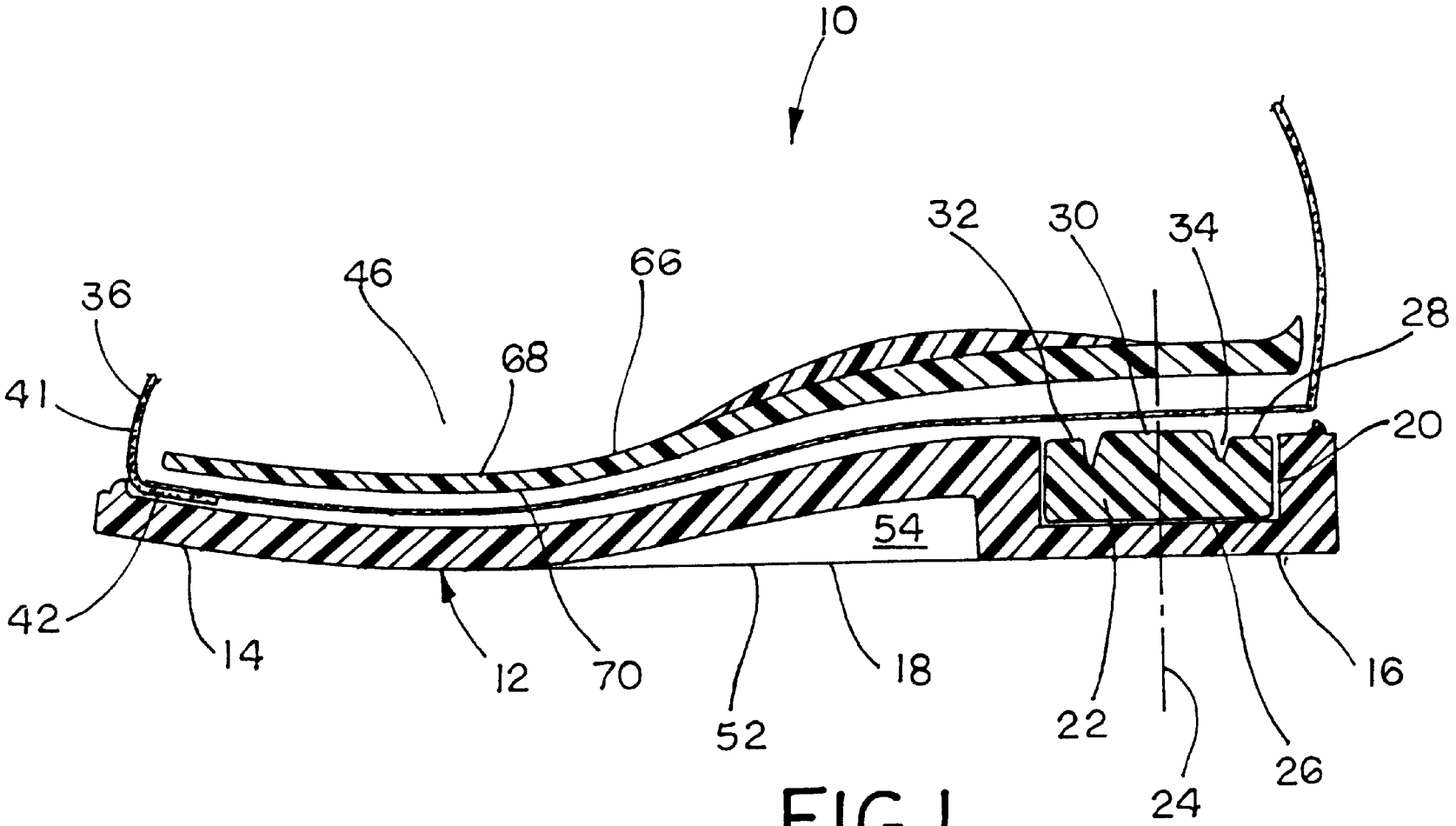
FIG. 1 is a fragmentary elevational view in cross-section of a shoe incorporating the features of the present invention and illustrating the outsole having a heel plug, the insole, the flexible insert and the upper.

The embodiment described herein is not intended to be exhaustive or to limit the scope of the invention to the precise form disclosed. The following embodiment has been chosen and described in order to best explain the principles of the invention and to enable others skilled in the art to follow its teachings.

Referring now to the drawings, a shock absorbing shoe assembled according to the teachings of the present invention is generally referred to by the reference numeral 10. Shoe 10 includes an outsole 12, and also includes a toe 14, a heel 16, and an interconnecting central portion 18. Heel 16 includes a recess or cavity 20 which receives therein a plug 22. Plug 22 is preferably constructed of a resilient elastomeric material, or any other suitable material exhibiting resiliency and shock absorbing qualities. Plug 22 is preferably generally cylindrical, oval, or elliptical in shape, and defines a central axis 24. Plug 22 further includes a bottom surface 26 and an upper surface 28 having a raised center portion 30 surrounded by an outer boundary 32. An annular depression 34 separates center portion 30 from outer boundary 32.

Figure 2:
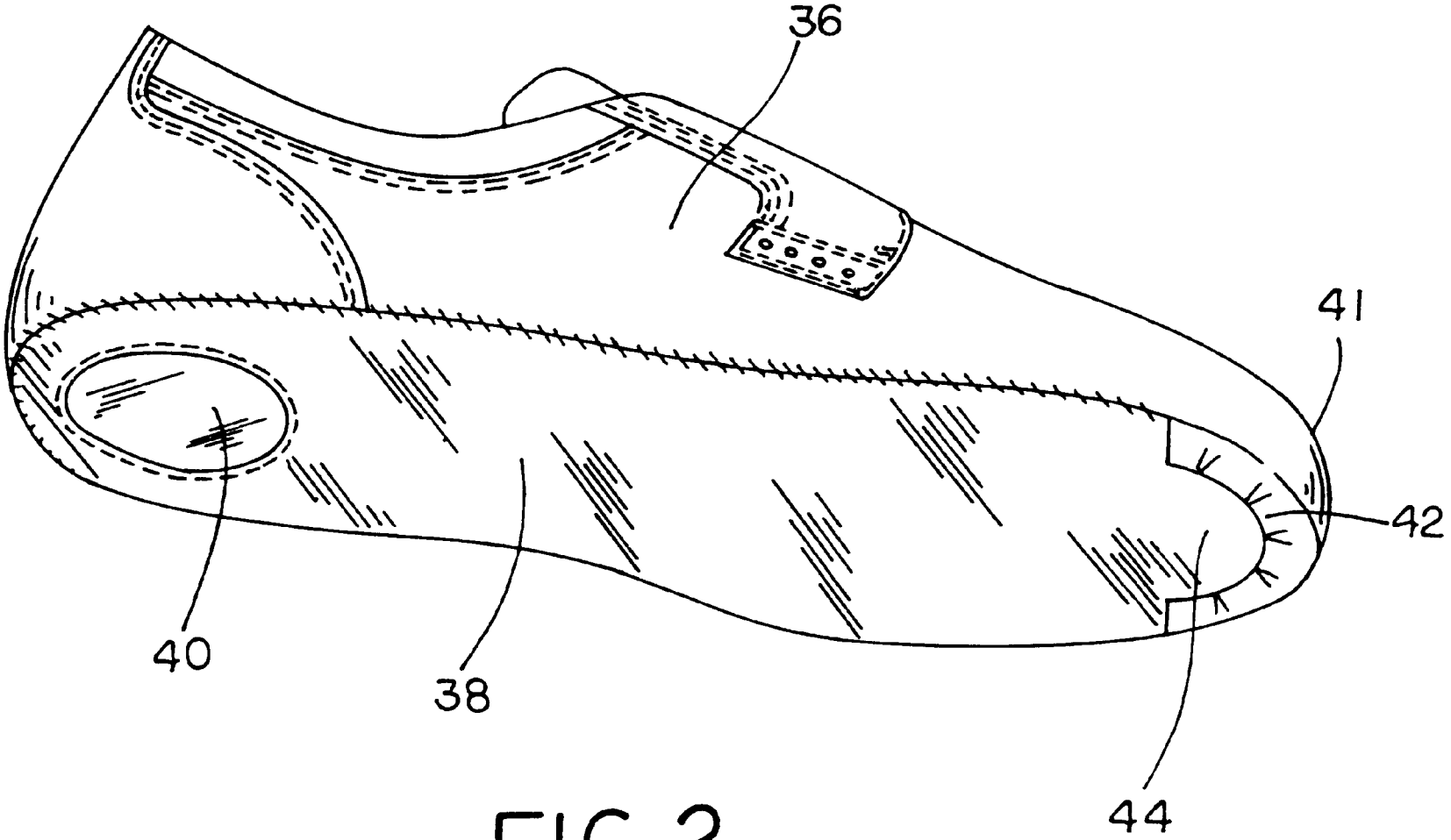
FIG. 2 is a fragmentary view in perspective, taken from below, of the insole portion of the present invention illustrating the transparent window portion and shown attached to a conventional upper.

Shoe 10 also includes an upper 36 as shown in FIG. 2, which is stitched to an insole 38. Insole 38 includes a flexible portion or window 40, which is preferably transparent, and which is disposed above the plug 22 such that the plug 22 is observable through the flexible window 40. The upper 36 includes a toe portion 41, which includes a lip or flange 42 that is glued, bonded or otherwise secured to a forward portion 44 of insole 38. The upper 36 defines an interior 46 for receiving the foot of a wearer as is conventional.

Figure 3:
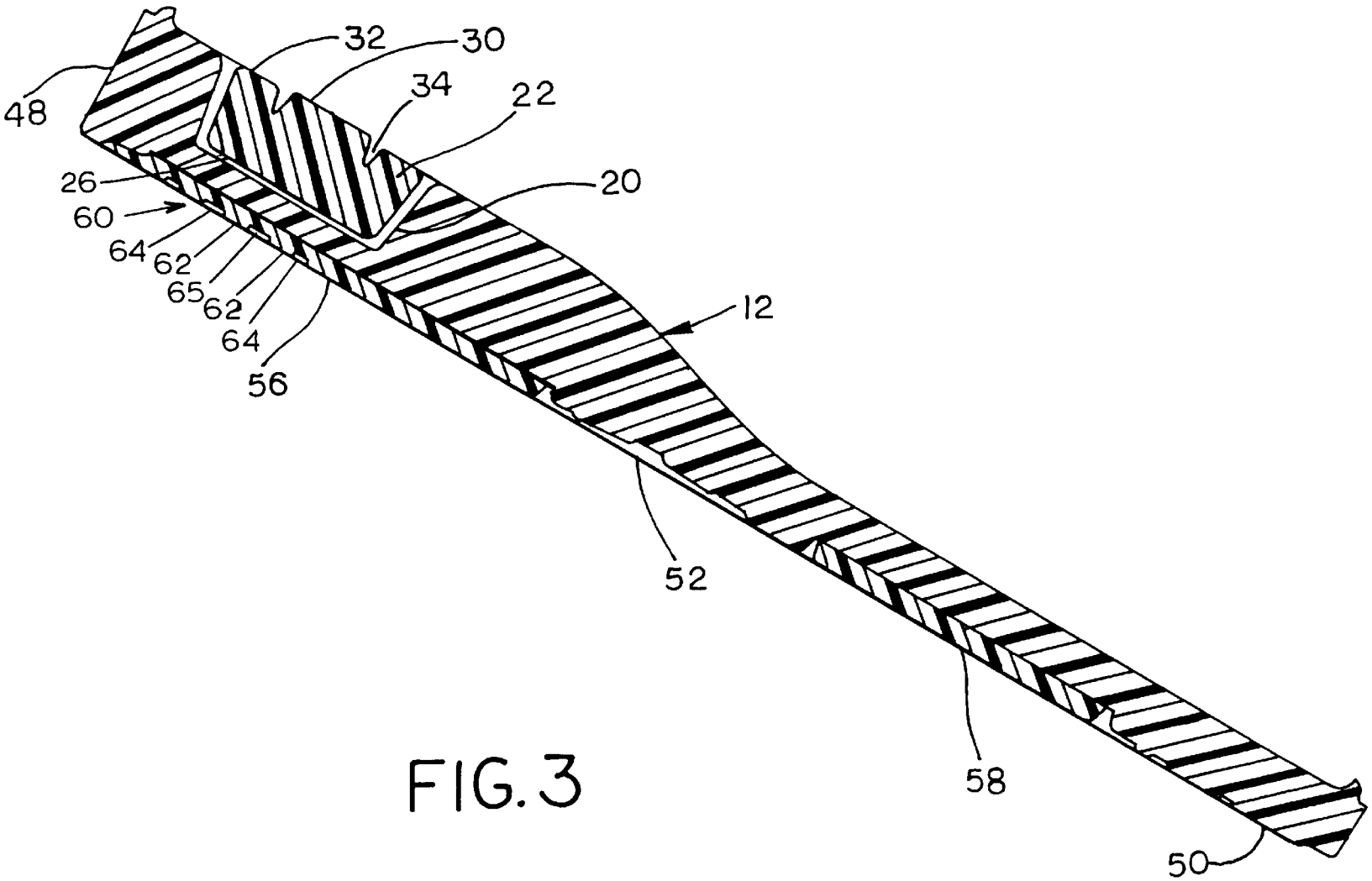
FIG. 3 is a fragmentary cross-sectional view of the multi-density outsole having the elastomeric plug disposed in the heel.
Figure 6:
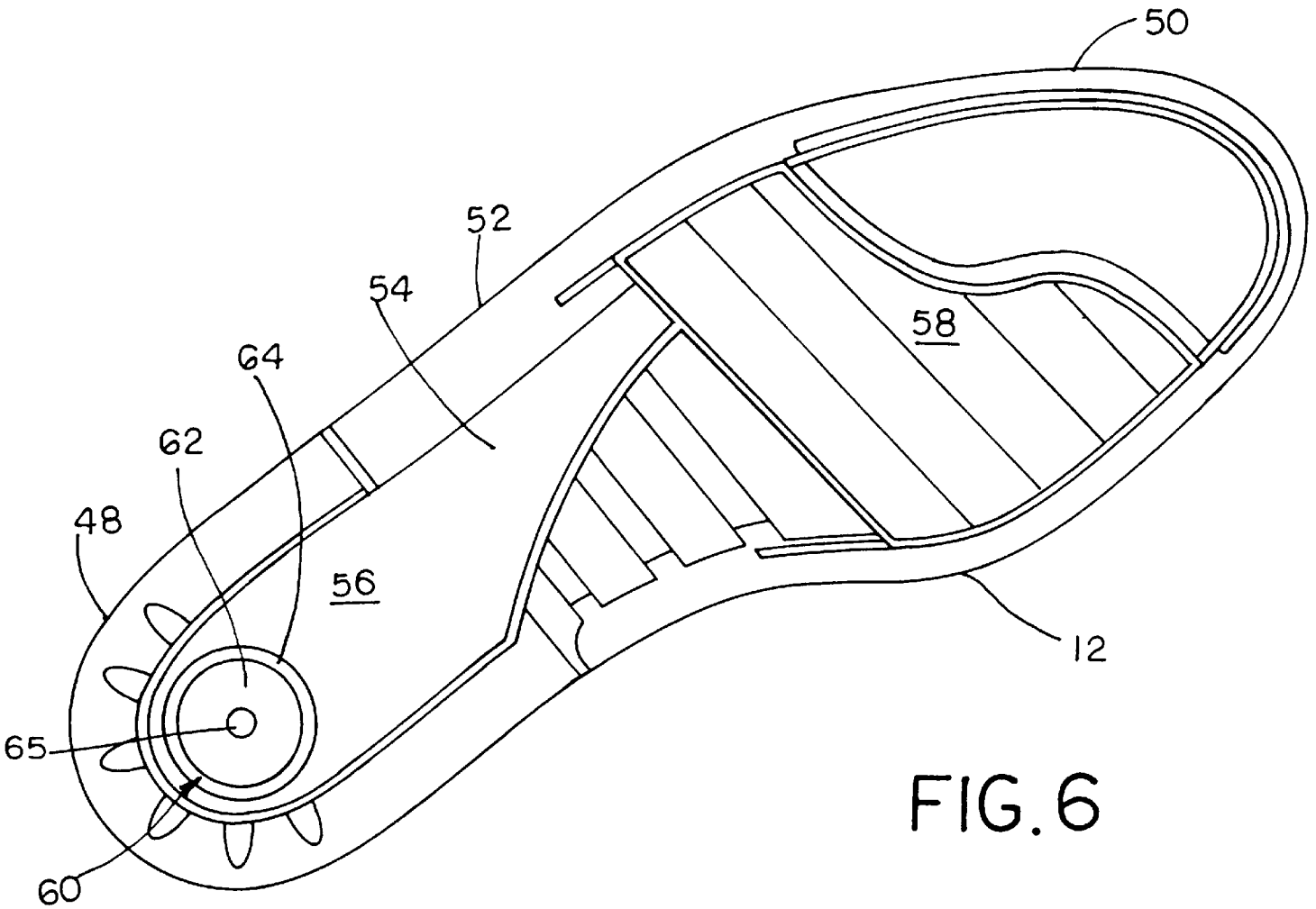
FIG. 6 is a bottom plan view of the multi-density outsole illustrating the heel plunger and the integral molded shank.

Referring now to FIGS. 3 and 6, outsole 12 includes a heel 48, a toe 50, and an intermediate shank 52 having a stiffening member 54. Outsole 12 is preferably constructed of blown polyurethane, and includes a rear area 56 and a forward area 58 each of which is constructed of elastomeric polyurethane having a different density then the balance of outsole 12. The stiffening member 54 is preferably oriented diagonally with respect to the longitudinal dimension of outsole 12. A circular plunger 60 is molded into the heel portion 48 of the outsole 12, and includes a central ring 62 surrounded by an annular depression or groove 64. A circular dimple or depression 65 is formed at the center of the ring 62. The ring 62 of plunger 60 is preferably generally coincident with the axis 24 of the plug 22. The upper 36, insole 38, and outsole 12 are connected in a manner well known in the art. Preferably, area 56, which encompasses center 62, and area 58 have a density of about 1.03 grams per cubic centimeter, although variations therefrom are contemplated, depending on the requirements of the user.

Figure 4:
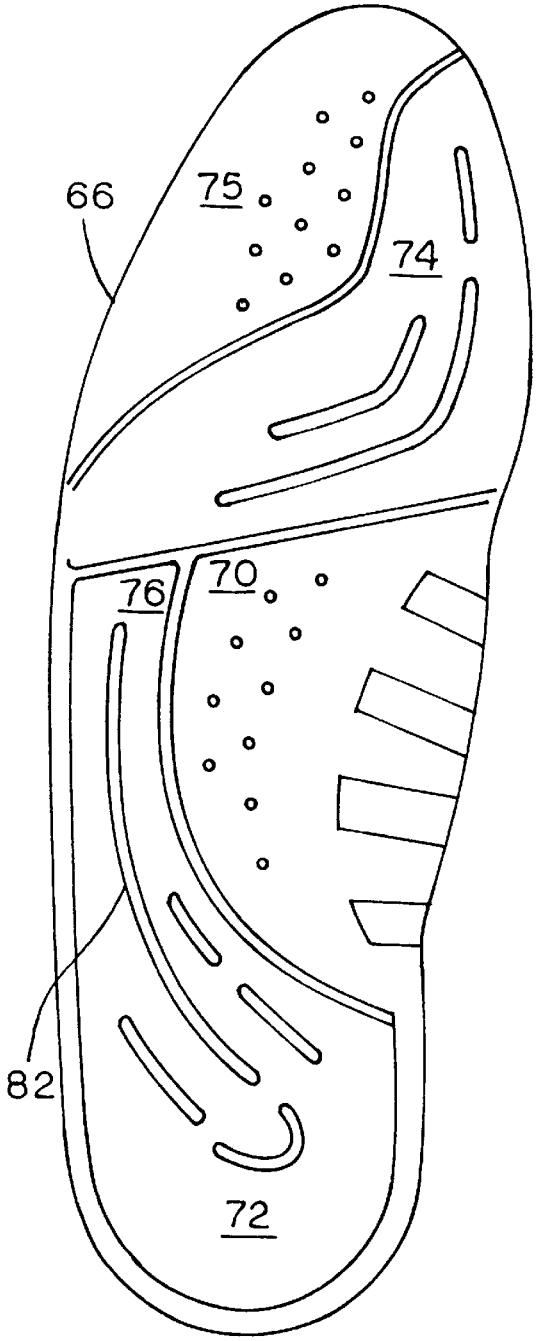
FIG. 4 a bottom plan view of the resilient flexible insert illustrating the various impact zones and further showing the approximate dividing lines between areas of different density.
Figure 5:
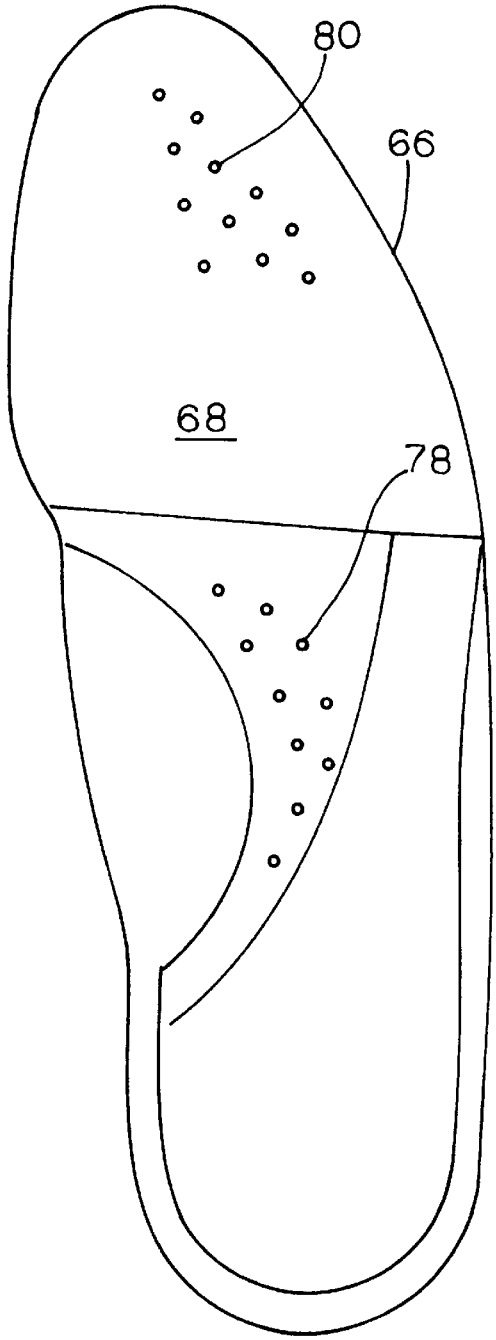
FIG. 5 is a top plan view of the resilient flexible insert shown in FIG. 4.

Referring now to FIGS. 1, 4, and 5, a flexible resilient insert 66 is shaped to be received within the interior 46 of shoe 10 overlying the insole 38. Insert 66 includes an upper surface 68, which is preferably constructed of a breathable and absorbent material, and further includes a lower surface 70 as shown in FIG. 4. Insert 66 includes a heel zone 72, a ball zone 74, a toe zone 75 and an intermediate zone 76. At least a portion of zones 72, 74, 75 and 76 are constructed of elastomeric polyurethane which may be of the same or different densities. Zones 74 and 76 preferably have a density in the neighborhood of 1.03 grams per cubic centimeter. Again, variations therefrom are contemplated depending specific user requirements. Insert 66 further includes a plurality of holes or perforations 78, 80 adjacent the intermediate portion 76 and the toe zone 75, respectively. Bottom surface 70 of insert 66 further includes a plurality of linear and curvilinear channels 82 which enhance the shock absorbing characteristics of the elastomeric material in zones 72, 74, 75 and 76.

In operation, the insole 38 having the attached upper 36 shown in FIG. 2 is secured to the outsole 12 as shown in FIG. 1 using conventional shoe assembly methods. The insert 66 is placed within the interior 46 as is commonly accomplished in the art. Upon application of a load, such as from the foot of a wearer (not shown) the shoe will respond substantially as described below. Upon the initiation of a stride, a generally axial load is applied adjacent the heel portion of the shoe, generally coaxial with the axis 24 of plug 22. When this occurs, a portion of the force is applied to the raised center portion 30 of plug 22 via the flexible portion 40 of insole 38, thus depressing the raised portion 30 of plug 22. At a subsequent point, the elastomeric material of the raised portion 30 spreads out into the annular depression 34, until the outer boundary 32 is recruited to assist in resisting the load. At the same time, the elastomeric material in rear portion 72 of insert 66 spreads into the channels 82, absorbing a portion of the load in the process. Finally, the raised ring 64 of plunger 60 spreads into the space of the depressed center 62 and the groove 65 on outsole 12, thus also absorbing a portion of the load.

As the wearer strides forward, the shoe 10 responds by transmitting a portion of the load through the diagonal stiffening member 54 and a portion of the shock or impact is absorbed by the elastomeric polyurethane areas 56 and 58 of outsole 12. Additional impact loads are absorbed by the channels 82 in the intermediate, ball, and toe zones 76, 74, and 75 respectively, of insert 66. Perforations 78, 80 provide ventilation through insert 66 during the walking process to enhance comfort. Stiffening member 54 stiffens the intermediate shank 52, yet still permits the outsole 12 to absorb shock. As the stride is completed, the impact forces are absorbed by the ball zone 74 and the toe zone 75 of the flexible insert 66, as well as by the forward area 58 of outsole 12.

It will be understood that the above description does not limit the invention to the above-given details. It is contemplated that various modifications and substitutions can be made without departing from the spirit and scope of the following claims.

What is claimed:

1. A shoe comprising:

an outsole having a heel portion, a toe portion, and a shank portion interconnecting the heel portion and the toe portion, the heel portion including an upwardly opening cavity;

an elastomeric plug disposed in the cavity, the elastomeric plug including a central axis, a generally planar lower surface and an upper surface, the upper surface having a raised central portion, an outer boundary, and an annular depression separating the raised central portion from the outer boundary, the elastomeric plug being adapted to permit deformation of the plug in two phases in response to the application of a load generally coaxial with the central axis of the elastomeric plug, the first phase being defined by a downward and outward displacement of the raised central portion, the second phase being defined by the outer boundary being recruited to resist the load; and the outsole heel portion further having a downwardly facing plunger defined therein, the plunger being spaced downwardly away from a bottom surface of the elastomeric plug, the plunger including a ring surrounded by a groove and having a center, the center and the groove extending into a bottom surface of the heel portion, the plunger being generally aligned with the elastomeric plug central axis, the plunger being adapted to deform in response to the application of the generally coaxial load;

whereby the elastomeric plug and the plunger progressively deform in response to the application of the generally coaxial load thereby cooperating to resist the load.

2. The shoe of claim 1, wherein the shank portion includes a stiffening member, the stiffening member being integrally formed in the outsole.

3. A shoe comprising:

an outsole having a heel, a toe, and an interconnecting shank, the heel including an upwardly opening cavity;

an elastomeric plug disposed in the cavity, the elastomeric plug including a central axis and further having a generally planar lower surface and an upper surface, the upper surface having a raised central portion, an outer boundary, and an annular depression separating the central portion from the outer boundary, the elastomeric plug being adapted to permit deformation of the plug in two phases in response to the application of a load generally coaxial with the central axis of the elastomeric plug, the first phase being defined by a downward and outward displacement of the central portion, the second phase being defined by the outer boundary also resisting the load; and a downwardly facing plunger formed in the heel of the outsole, the plunger being spaced from the bottom surface of the elastomeric plug, the plunger being defined by a ring formed in the outsole and being surrounded by a groove extending into a bottom surface of the outsole, the ring being generally coaxial with the plug central axis, the ring being adapted to deform in response to the application of the generally coaxial load;

a flexible insole secured to and overlying the outsole; and a removable flexible insert adapted to overlie the insole, the insert having an elastomeric heel portion overlying the outsole heel and an elastomeric toe portion overlying the outsole toe, the insert heel portion and the insert toe portion each having defined therein a plurality of channels disposed generally parallel to the outsole, the flexible insert further including a plurality of ventilation holes oriented perpendicular to the outsole;

whereby the outsole, the insole, and the insert define a plurality of shock absorbing zones, including a first zone generally coincident with the heel and being generally coaxial with the elastomeric plug and the circular plunger, a second zone generally coincident with the shank, and a third zone generally coincident with the toe, and further whereby the first, second and third shock absorbing zones absorb shock from the foot of a wearer in response to a load progressing between the heel and the toe.

4. The shoe of claim 3, wherein the flexible insert includes a elastomeric portions generally overlying the first, second and third zones, one of the portions having a first density and another of the portions having a second density.

5. The shoe of claim 4, wherein the elastomeric portions include a plurality of channels disposed generally parallel to the outsole.

* * * * *